US005388038A

United States Patent [19]

Yang

[11] Patent Number: 5,388,038

[45] Date of Patent: Feb. 7, 1995

[54] LIGHTING PEN

[76] Inventor: Shyue-Jong A. Yang, 19847 E. Country Hollow Dr., Walnut, Calif. 91789

[21] Appl. No.: 198,861

[22] Filed: Feb. 18, 1994

[51] Int. Cl.[6] ..... B43K 29/10

[52] U.S. Cl. ..... 362/118; 362/157

[58] Field of Search ..... 362/118, 157, 109, 202, 362/205

[56] References Cited

U.S. PATENT DOCUMENTS

| | | | |
|---|---|---|---|
| 3,004,140 | 10/1961 | Gomes | 362/118 |
| 3,045,111 | 7/1962 | Hoenig | 362/118 |
| 3,333,095 | 7/1967 | Moess | 362/118 |
| 4,168,521 | 9/1979 | Bajusz | 362/118 |
| 4,737,894 | 4/1988 | Kuch et al. | 362/118 |

*Primary Examiner*—Richard R. Cole

[57] ABSTRACT

The lighting pen is a writing instrument with an illuminating device for the user to be able to write in the dark. It is composed of two major compartments, the head and battery compartments. The head compartment includes a pen point which is integrated with the ink cartridge, transparent plastic shell, lens, cylinder cover, light bulb, and on/off switch. The battery compartment is made of electrical conducting material which contains two batteries.

1 Claim, 2 Drawing Sheets

LIGHTING PEN

BACKGROUND OF THE INVENTION

1. Field of the Invention

The present invention relates to the integration of a writing with an illuminating device, which provides light for the user to be able in the dark.

2. Description of the Prior Art

Previous patents which describe self-illuminated pen are:

| | | |
|---|---|---|
| [A] | U.S. Pat. No. 3,004,140 | Gomes |
| [B] | U.S. Pat. No. 4,168,521 | Bajusz |
| [C] | U.S. Pat. No. 3,045,111 | Hoenig |
| [D] | U.S. Pat. No. 3,333,095 | Moess |
| [E] | U.S. Pat. No. 4,737,894 | kuch et al |

None of the prior patents declares how to clear the shade caused by the cartridge and pen point. All prior patents except Gomes's have the on/off switch on the top part of the pen. It is very inconvenient for the user to turn off and on the pen when he/she wants to take a short pause or break during the writing. The user has to move up and down the fingers that causes the changing of current writing status, otherwise he/she has to leave the light on until finishing the whole writing.

SUMMARY Accordingly, it is the object of the present invention to provide a novel and improved writing instrument with an illuminating device for the user to be able to write in the dark.

A convex lens is inserted between the light bulb and ink cartridge to concentrate the light to the front end and eliminate the shade from the cartridge. The on/off switch is positioned right on the finger holding area, so the user can turn on or off the light any time he/she wants.

The battery compartment is made of electrical conducting material which contains two batteries.

BRIEF DESCRIPTION OF THE DRAWINGS

The object and features of the present invention will become apparent from the following.

DESCRIPTION OF THE PREFERRED EMBODIMENT

Figure 1:
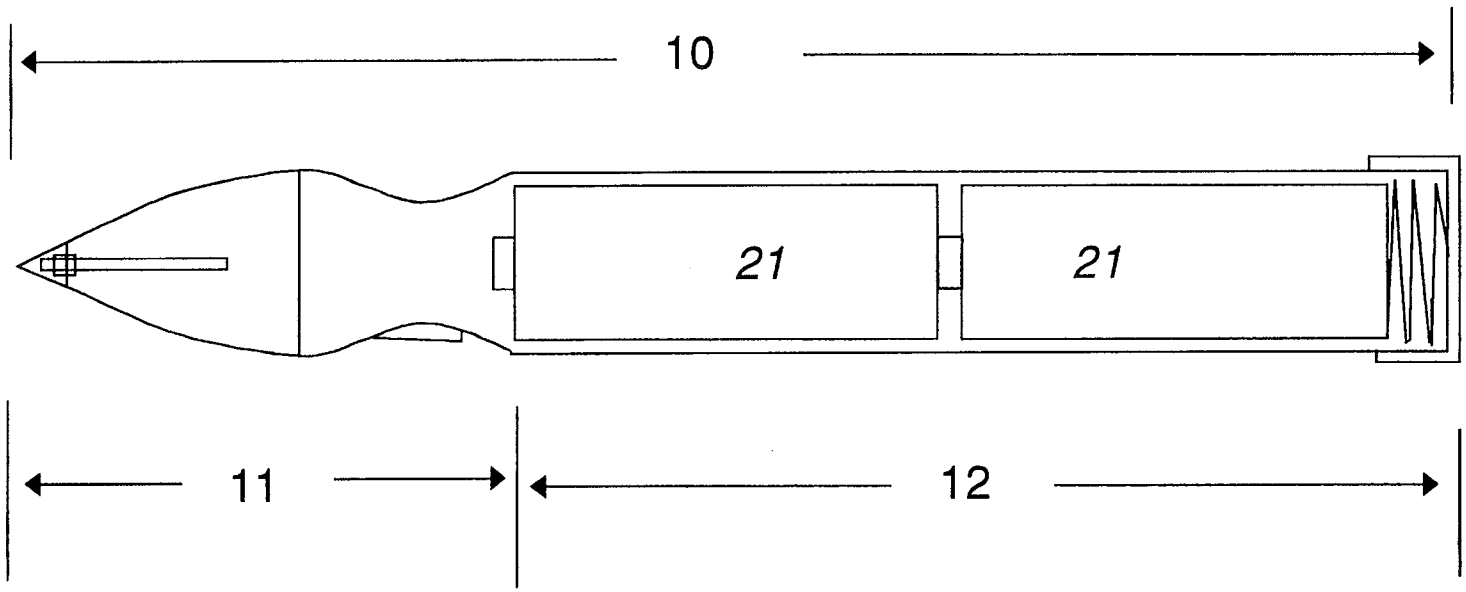
FIG. 1 is the whole view of a lighting pen. It has two compartments: a head compartment and a battery compartment.

Referring to the drawing, the lighting pen general is designated 10 in FIG. 1. It has two major compartments: a head compartment 11 and a battery compartment 12. The battery compartment can contain two batteries 21.

Figure 2:
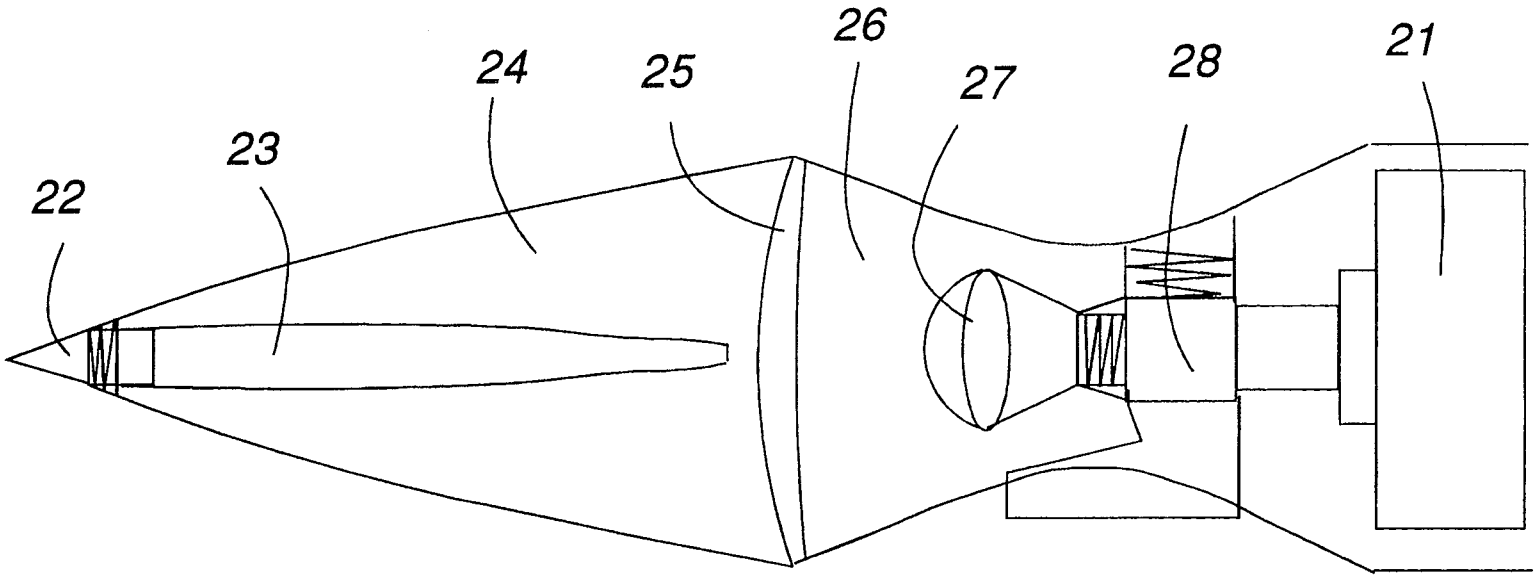
FIG. 2 is the detailed drawing of individual parts in the head compartment.

The head compartment 11 is illustrated in FIG. 2. The pen point 22 is integrated with the ink cartridge 23 which forms a writing device. The transparent shell 24 is a clear plastic cover, which allows the light to pass through with a minimum of interference.

There is a convex lens 25 inserted between the plastic shell 24 and the cylindric shape cover 26 to concentrate the light to the front end and reduce the shade from the cartridge.

A light bulb 27 is connected to the on/off switch 28 as the illuminating source. The on/off switch 28 controls the electrical conductor. The user presses the bottom down to connect the conductor and the light is on, then presses it again to lose the connection and the light is off.

The battery compartment 12 can contain two batteries 21 for longer usage.

I claim:

1. A self-illuminable writing instrument comprising:

a first missile shape part comprising a first compartment as a head compartment;

a second enlarged hollow portion comprising a second compartment as a battery compartment;

a pen point which integrates with an ink cartridge positioned in said head compartment;

a transparent plastic shell that covers the cartridge; a light bulb located behind said pen point and said ink cartridge in said head compartment and connected to an on/off switch in said head compartment;

a convex lens inserted between the bulb and ink cartridge in said head compartment;

said on/off switch positioned in said head compartment between the bulb and battery compartment;

two batteries stored in said battery compartment and being electrically connected to said bulb and said switch.

* * * * *